US009339687B2

(12) United States Patent
Loane et al.

(10) Patent No.: US 9,339,687 B2
(45) Date of Patent: May 17, 2016

(54) SKI EXERCISE APPARATUS

(71) Applicants: R Joel Loane, Park City, UT (US); Ty Hargroder, Los Angeles, CA (US)

(72) Inventors: R Joel Loane, Park City, UT (US); Ty Hargroder, Los Angeles, CA (US)

( * ) Notice: Subject to any disclaimer, the term of this patent is extended or adjusted under 35 U.S.C. 154(b) by 0 days.

(21) Appl. No.: 14/942,443

(22) Filed: Nov. 16, 2015

(65) Prior Publication Data

US 2016/0067544 A1 Mar. 10, 2016

Related U.S. Application Data

(62) Division of application No. 14/068,950, filed on Oct. 31, 2013, now Pat. No. 9,186,543.

(51) Int. Cl.

| | |
|---|---|
| ***A63B 69/18*** | (2006.01) |
| ***A63B 71/00*** | (2006.01) |
| ***A63B 22/00*** | (2006.01) |
| ***A63B 22/20*** | (2006.01) |

(52) U.S. Cl.

CPC ..... *A63B 22/203* (2013.01); *A63B 2244/19* (2013.01)

(58) Field of Classification Search

CPC ..... A63B 22/00; A63B 22/20; A63B 22/203; A63B 22/201; A63B 22/205; A63B 2022/206; A63B 69/18; A63B 69/182; A63B 2244/19; A63B 21/4011; A63B 21/4013; A63B 21/4015; A63B 22/0046; A63B 2022/0033; A63B 69/0022

USPC ..... 482/51–53, 70, 71; 434/253, 255; 473/217, 218, 269–273, 452; 280/611–637

See application file for complete search history.

(56) References Cited

U.S. PATENT DOCUMENTS

| | | | | | |
|---|---|---|---|---|---|
| 2,253,012 | A * | 8/1941 | Benner | A63C 5/035 | 280/11.19 |
| 2,338,249 | A * | 1/1944 | Jansen | A63C 9/08507 | 280/619 |
| 2,455,274 | A * | 11/1948 | Scriver | A63B 69/18 | 434/253 |
| 3,104,887 | A * | 9/1963 | Riche et al. | A63C 17/14 | 280/11.209 |
| 3,261,615 | A * | 7/1966 | Beyl | A63C 9/083 | 280/621 |
| 3,291,500 | A * | 12/1966 | Voster | A63C 9/0842 | 280/632 |
| 3,490,783 | A * | 1/1970 | Shimizu | A63C 9/005 | 280/626 |
| 3,556,543 | A * | 1/1971 | Overgaard | A63C 9/007 | 280/632 |
| 3,677,566 | A * | 7/1972 | Lawrence | A63C 9/0847 | 280/631 |
| 3,707,283 | A * | 12/1972 | Cormier | A63B 69/18 | 482/71 |
| 3,716,248 | A * | 2/1973 | Wiley | A63C 9/08 | 280/618 |

(Continued)

*Primary Examiner* — Oren Ginsberg
*Assistant Examiner* — Garrett Atkinson
(74) *Attorney, Agent, or Firm* — Donald R. Boys; Central Coast Patent Agency, Inc.

(57) ABSTRACT

A method for using a ski exercise machine involves steps for putting on a pair of ski boots, stepping onto a pair of foot pads on the ski exercise machine one at a time, the foot pads implemented on a carriage rolling on arcuate rails, engaging a rearward portion of the sole of each ski boot in each foot pad beneath a heel retainer plate as a part of each foot pad, such that the heel portion of the ski boot is constrained vertically, placing the toe of each ski boot behind an adjustable toe stop on each foot pad such that the ski boot is constrained from moving forward in the foot pad, but the toe is not constrained vertically, and grasping a hand rail as part of the ski exercising apparatus and urging the carriage side to side on the arcuate rails, simulating skiing activity.

5 Claims, 7 Drawing Sheets

(56) References Cited

U.S. PATENT DOCUMENTS 3,729,207 A * 4/1973 Reynolds ..... A63C 5/035 280/11.208
3,854,744 A * 12/1974 Salomon ..... A63C 9/086 280/618
4,251,068 A * 2/1981 Tarnacki ..... A63B 22/16 482/146
4,266,806 A * 5/1981 Weigl ..... A63C 9/081 280/618
4,743,014 A * 5/1988 Loane ..... A63B 69/18 482/130
4,744,557 A * 5/1988 Smirmaul ..... A63B 69/18 434/253
4,744,558 A * 5/1988 Smirmaul ..... A63B 69/18 434/253
4,953,853 A * 9/1990 Loane ..... A63B 69/18 482/130
5,020,793 A * 6/1991 Loane ..... A63B 69/18 434/253
5,147,257 A * 9/1992 Loane ..... A63B 69/18 482/146
5,188,578 A * 2/1993 Voigt ..... A63B 22/16 482/146
6,569,064 B1 * 5/2003 Loane ..... A63B 21/154 482/146
7,090,621 B2 * 8/2006 Loane ..... A63B 21/4007 482/51
7,303,511 B2 * 12/2007 Bull ..... A63B 21/15 482/51
7,803,091 B2 * 9/2010 Loane ..... A63B 21/4007 482/51
7,867,139 B2 * 1/2011 Loane ..... A63B 21/4011 482/1
2006/0211544 A1 * 9/2006 Loane ..... A63B 21/4007 482/70
2009/0176631 A1 * 7/2009 Blessing ..... A63B 22/0061 482/71

* cited by examiner

SKI EXERCISE APPARATUS

CROSS REFERENCE TO RELATED DOCUMENTS

The present application is a divisional application of application Ser. No. 14/068,950, filed on Oct. 31, 2013, issuing as U.S. Pat. No. 9,186,543 on Nov. 17, 2015, and all disclosure of the parent application is incorporated herein at least by reference.

BACKGROUND OF THE INVENTION

1. Field of the Invention

The present invention is in the technical area of exercising apparatus simulating techniques used in skiing, and pertains more particularly to an apparatus that enables a user to exercise in ski boots.

2. Description of Related Art

Apparatus in the art for providing exercise while simulating techniques used in skiing is well known, but such apparatus at the time of the filing of the present patent application does not provide for a user to wear his or her ski boots while using the apparatus in a manner that simulates the actual feel that is experienced with the boots attached to an actual pair of skis, while also providing safe exit from the apparatus. This is because to capture the feel of having the boots on, with the boots attached to skis, requires that the user have the boots on, and attached to foot pads of the apparatus in a manner similar to the attachment to skis. In this circumstance the user of the exercise apparatus cannot step off the apparatus at need.

What is clearly needed in the art is a ski exercise apparatus that enables users to safely exercise with their ski boots on.

BRIEF SUMMARY OF THE INVENTION

In one embodiment of the present invention a method is provided, comprising putting on a pair of ski boots by a person seeking to exercise on a ski exercise machine, stepping onto a pair of foot pads on the ski exercise machine one at a time, the foot pads implemented on a carriage rolling on arcuate rails, engaging a rearward portion of the sole of each ski boot in each foot pad beneath a heel retainer plate as a part of each foot pad, such that the heel portion of the ski boot is constrained vertically, placing the toe of each ski boot behind an adjustable toe stop on each foot pad such that the ski boot is constrained from moving forward in the foot pad, but the toe is not constrained vertically, and grasping a hand rail as part of the ski exercising machine and urging the carriage side to side on the arcuate rails, simulating skiing activity.

In one embodiment of the method the person adjusts position of the adjustable toe stop prior to mounting the ski exercise machine to exercise. Also in one embodiment the person, having exercised on the ski exercise machine, lifts the toes of the ski boots above the toe stops one at a time, slides the boots forward one at a time, disengaging the sole portion from under the heel retainer plate, freeing the ski boots from the foot pads, and steps off the ski exercise machine onto a platform assembly. Also in one embodiment, at the time of stepping off, the rolling carriage is near one end of the arcuate rails, and therefore at a height lesser than at a center of the arcuate rails, and the skier steps off the ski exercise machine onto one of two lower levels of the platform assembly. And in one embodiment, at the time of stepping off, the rolling carriage is near a center of the arcuate rails, and the skier steps off onto a center, higher level of the platform assembly.

DETAILED DESCRIPTION OF THE INVENTION

Figure 1:
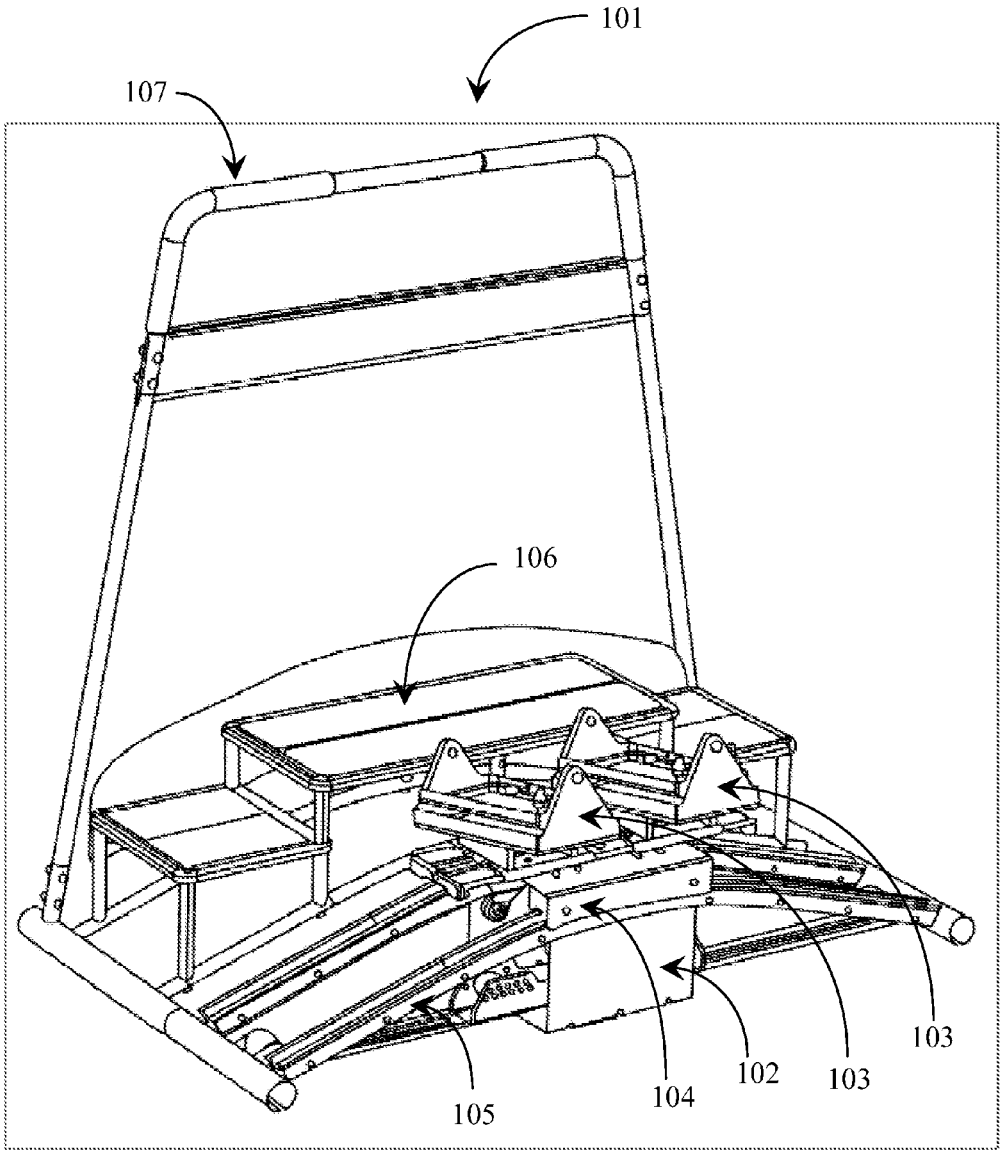
FIG. 1 is a perspective view of a ski exercise apparatus in an embodiment of the present invention.

FIG. 1 is a perspective view of a ski exercise apparatus 101 in an embodiment of the present invention. Apparatus 101 comprises a ski exercise apparatus 102 having foot pad assemblies 103 mounted to a rolling carriage 104 following arcuate rails 105. The rolling carriage is constrained by flexible rubber-like or elastic stretchable bands, such that the carriage is urged back toward the center of the arcuate rails when a user pushes the carriage to one side or the other. The general arrangement of the rolling carriage and rails simulates skiing activity for a user of the apparatus having his or her feet planted on foot pads within the foot pad assemblies. Apparatus of this sort is known in the art, but not with foot pads and other elements of the present invention as described below.

Apparatus 101 further comprises a platform assembly 106 having an uppermost level, and a lower level to each side of the uppermost level. There is, in addition, a hand rail apparatus 107 provided for a user to stabilize himself or herself during use. An important function of the unique arrangement of elements shown in FIG. 1, along with specific features described in enabling detail below is to enable a user to exercise with ski boots on.

Figure 2:
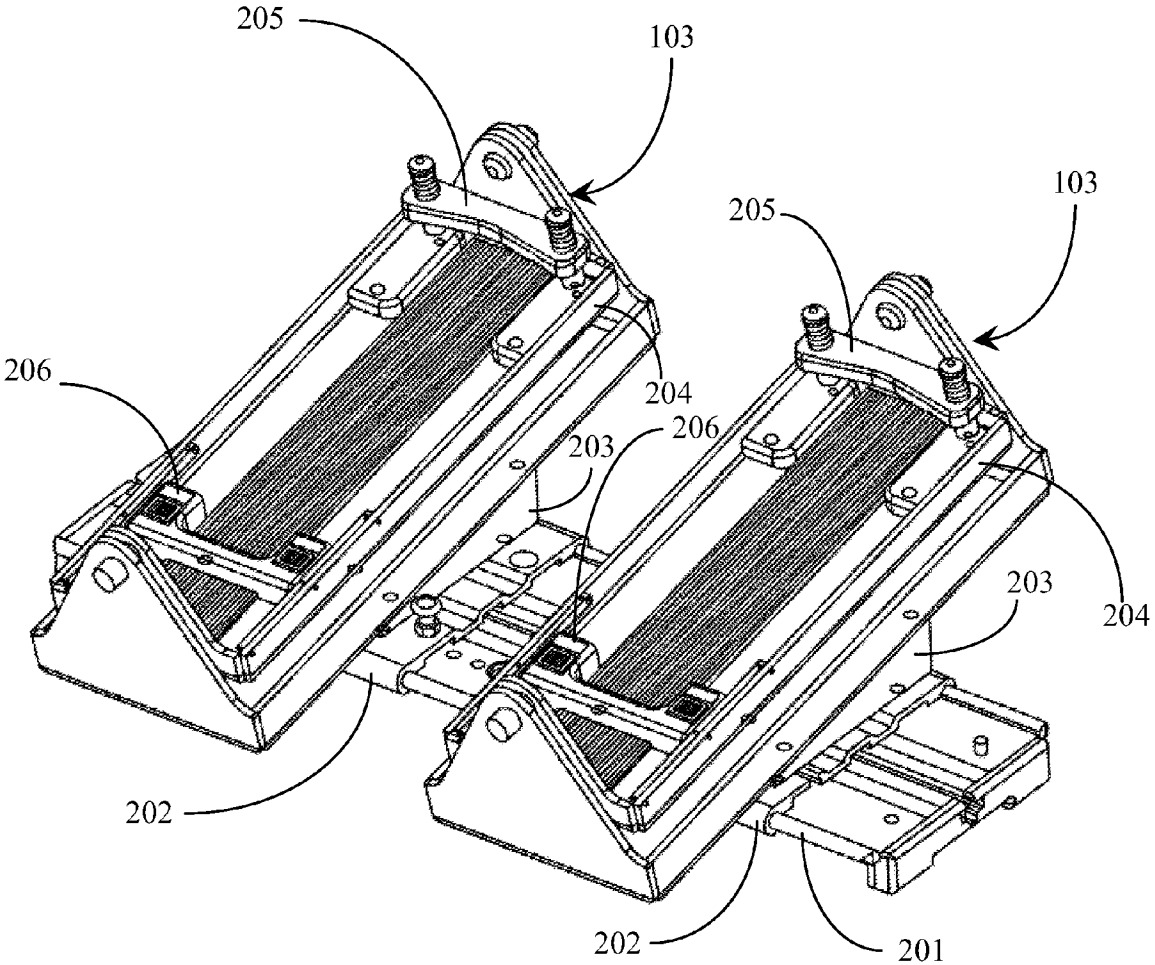
FIG. 2 is a perspective view of a set of foot pad assemblies on a ski exercise apparatus in an embodiment of the invention.

FIG. 2 is a perspective view of foot pad assemblies 103 mounted to the rolling carriage of FIG. 1 from a different viewpoint than that of FIG. 1. In this embodiment, footpad assemblies 103 are mounted to a platform 201 that mounts to carriage 104, each mounted separately to a sliding plate 202 that allows the footpads to be adjusted laterally to a comfortable position for a specific user. Each foot pad assembly 103 also comprises a foot pad 204 that is suspended on an axis orthogonal to the carriage direction, and above the foot level, such that the foot pad may rotate about the axis, allowing the user's feet to keep a comfortable aspect to the exercise apparatus.

Each foot pad assembly in this embodiment is mounted to sliding plate 202 by a wedge-shaped bracket 203 so that each foot pad assemble is canted forward at an angle of from about six to twenty-degrees toward platform assembly 106 and hand rail 107. This angle may vary depending on a number of circumstances, and provides a proper angle for the user, who will be gripping hand rail 107, to exercise with ski boots on.

A very important feature of each footpad 204 is apparatus provided with the foot pads for interfacing to a user's ski boots. Firstly a retainer plate 205 is provided at one end of the foot pad, away from the platform assembly, for engaging a sole of a ski boot at the heel of the boot. Heel retainer plate 205 is spaced above a floor plane of the footpad by a distance somewhat less than the thickness of the sole of the boot, and is spring-loaded vertically downward. The arrangement enables a user to step into the footpad and to engage the sole of each ski boot at the heel under spring-loaded heel retainer plate 205, so that, once engaged, the boot may not disengage vertically without first moving forward.

On each foot pad 204 a toe stop 206 is provided at the end of the foot pad 204 away from heel retainer plate 205. This toe stop enables the user, once the sole at the heel is engaged under heel retainer plate 205, to stand on the foot pads with the toe of the sole of the boot against the toe stop.

Figure 3:
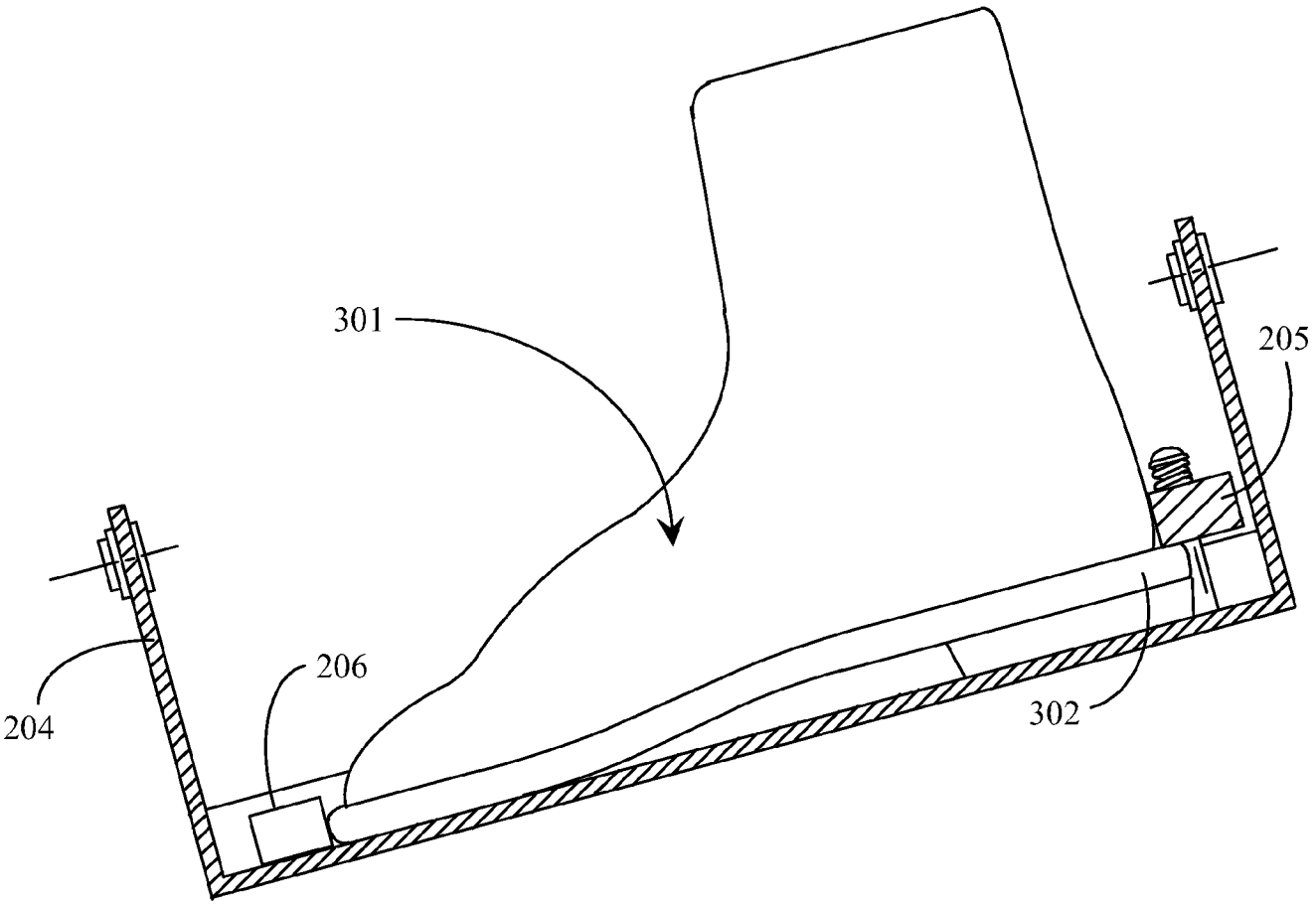
FIG. 3 is a cross section of one foot pad of FIG. 2 taken along the section line 3-3 of FIG. 2.

FIG. 3 is a cross section of one foot pad of FIG. 2 taken through the center of the footpad lengthwise, showing a ski boot engaged to the foot pad. Footpad 204 is indicated as suspended on each end to rotate about an axis 303, such that, as carriage 104 translates to each side and downward, following the arcuate rails, while a user, with ski boots engaged in the footpads, holds handrail 107, the plane of each footpad compensates so the user's feet follow natural positions as though the user were skiing.

Footpad 204 is shown in FIG. 3 as canted at the angle imposed by assembly to the carriage with bracket 203.

Ski boot 301 in FIG. 3 represents ski boots of various shapes and sizes, and is exemplary only. The foot pads in embodiments of the present invention are made to be compatible with International Organization for Standards (ISO) standards for ski boots, but also are compatible with ski boots according to other standards, and in other types and styles. The ski boot has a sole 302 that projects to the rear for a small distance, as is true in essentially all ski boots. As a user, wearing the boot, steps into the foot pad to exercise, he or she lifts the toe portion of the boot and pushes to the rear, engaging the extension of the sole at the heel portion of the boot beneath spring loaded heel retainer plate 205. When the sole is engaged beneath heel retainer plate 205, the user lowers the toe portion to rest on the planar floor of the foot pad, such that the toe of the boot locates just behind adjustable toe stop 206. The same engagement is accomplished with each of the foot pads and the user's boots. As the user leans forward, holding rail 107, weight is shifted on the forward sole of the boot, keeping the toe of the boot behind toe stop 206. The user's boots are thus firmly engaged in each of the foot pads while the user shifts to left and right, driving the carriage along the arcuate rails, simulating the actions of skiing and turning on the skis.

Importantly, the toe portions of the user's boots are not constrained vertically, and it is not necessary to do so, because the natural skiing actions keep weight on the forward portions of the boots. However, when the user is ready to stop, or if something happens that dictates a quick exit, the user may simply shift his or her weight to the rear, and the toe portions of the boots will lift, allowing the user to disengage the heel portions readily and step off the foot pads forward to platform 106. If the user is to the left or right, lower on the arcuate rails than the center portion, the user may step onto one of the two lower levels of platform 106. If the carriage at the point of exit is at the center, higher portion of the arcuate rails, the user may step onto the higher platform.

Figure 4:
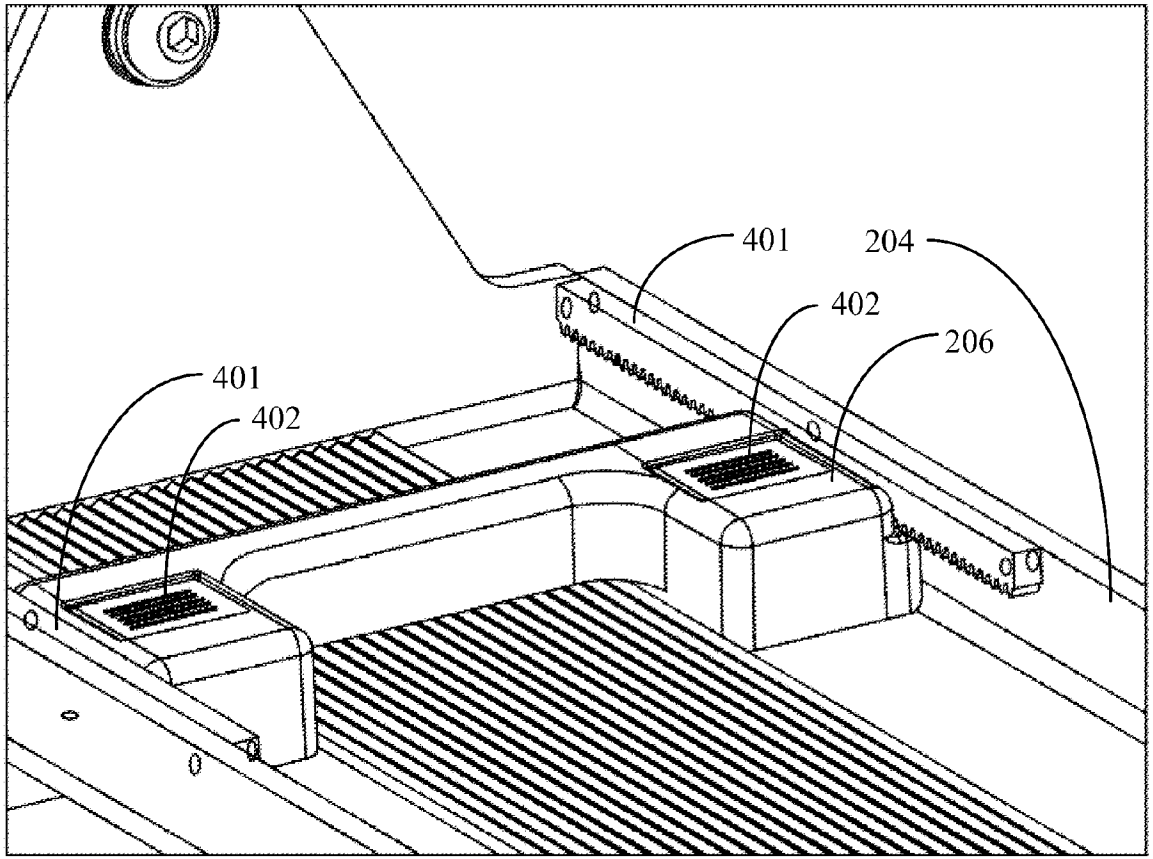
FIG. 4 is a perspective view of an adjustable toe stop associated with a foot pad in an embodiment of the invention.

FIG. 4 illustrates one foot pad 204 and one adjustable toe stop 206. In this example gear racks 401 are attached along a portion of the length of the foot pad on each side toward the toe area. A purpose of the racks is to engage a gear-toothed element below the toe stop on each side of the foot pad to hold the toe stop in an adjusted position once a user is satisfied with the position. The adjusting elements are described in more detail below with reference to further figures. Buttons 402 are spring-loaded elements used to disengage the toe stop on each side from racks 401 so the toe stop may be translated to a different position. Further detail of buttons 402 is also provided below.

Figure 5:
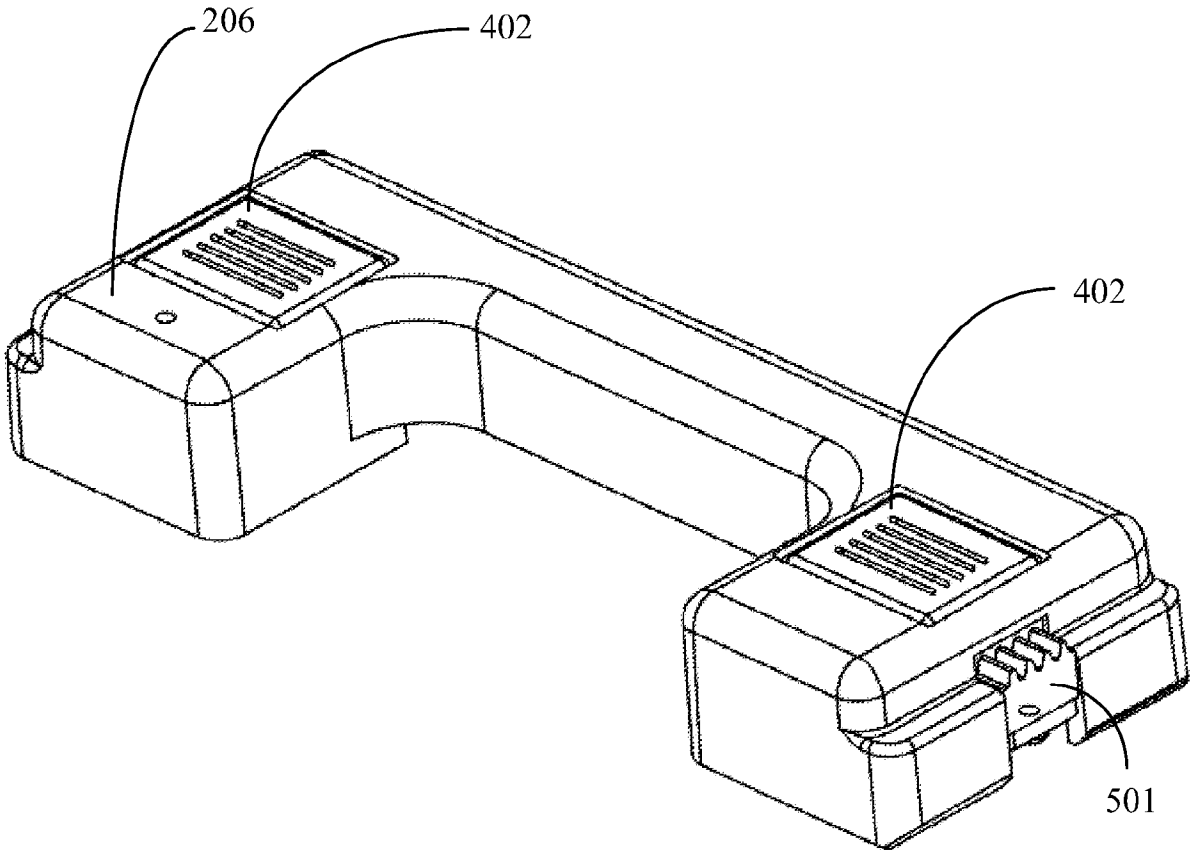
FIG. 5 is a perspective view of the adjustable toe stop of FIG. 4 in an embodiment of the invention.

FIG. 5 is a perspective view of one toe stop 206 illustrating spring-loaded buttons 402 and a short portion of a rack 501 adapted to engage rack 401 shown in FIG. 4. Rack 501 may be lowered to disengage from rack 401 by pressing button 402. A similar rack 501 is implemented on the opposite side of toe stop 206 to engage with rack 401 on that side of footpad 204.

Figure 6:
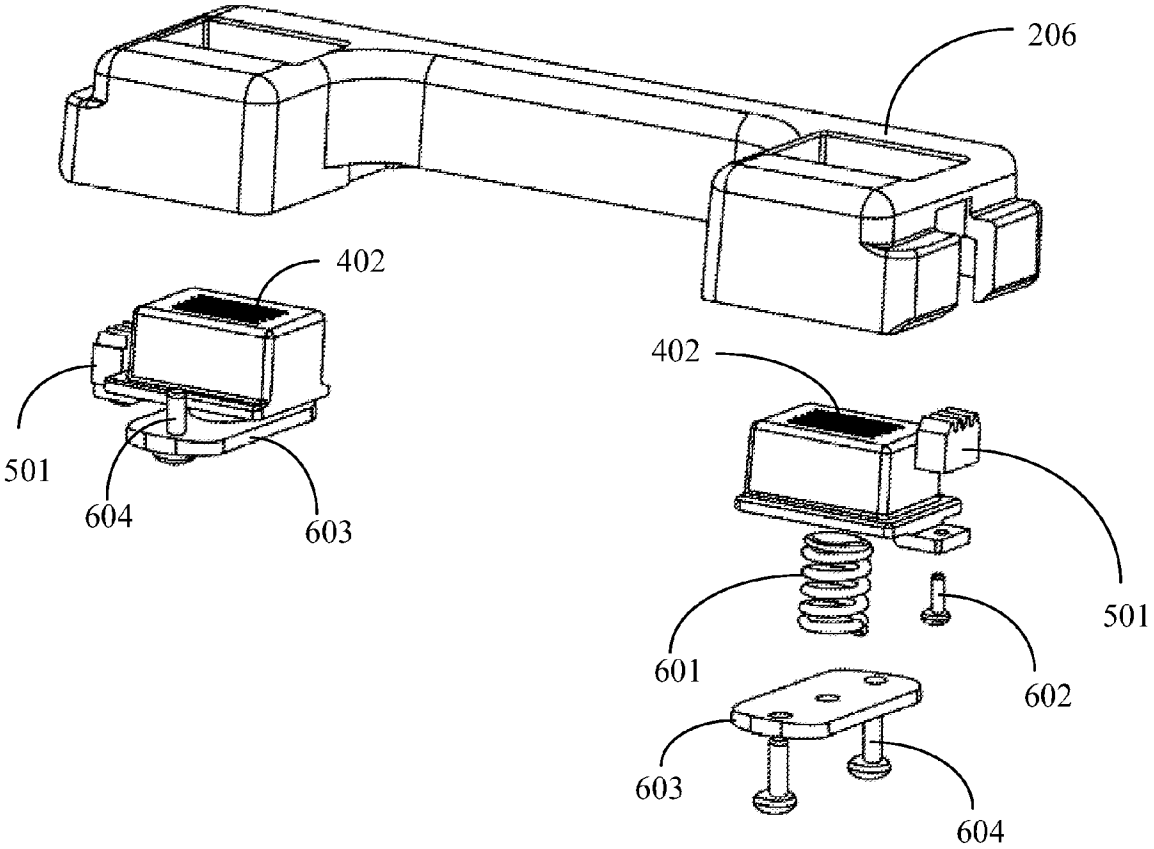
FIG. 6 is perspective exploded view of elements of the adjustable toe stop of FIG. 5.

FIG. 6 is an exploded view of the toe stop of FIG. 5 illustrating addition parts and association of those parts in the toe stop. Buttons 402 fit up into the toe stop and are spring-loaded by springs 601. Plate 603 compresses spring 601 and is held to toe stop by screw fasteners 604. Rack 501 is joined to button 402 by screw fastener 602. This assembly is mirrored on each side of the toe stop. One assembled, by pressing down on buttons 402 one may disengage rack 501 from rack 401 which is fastened to an inside edge of footpad 204. Toe stop 206 is held to foot pad 204 and guided in translation and adjustment by racks 501 engaged or disengaged with racks 401.

Figure 7:
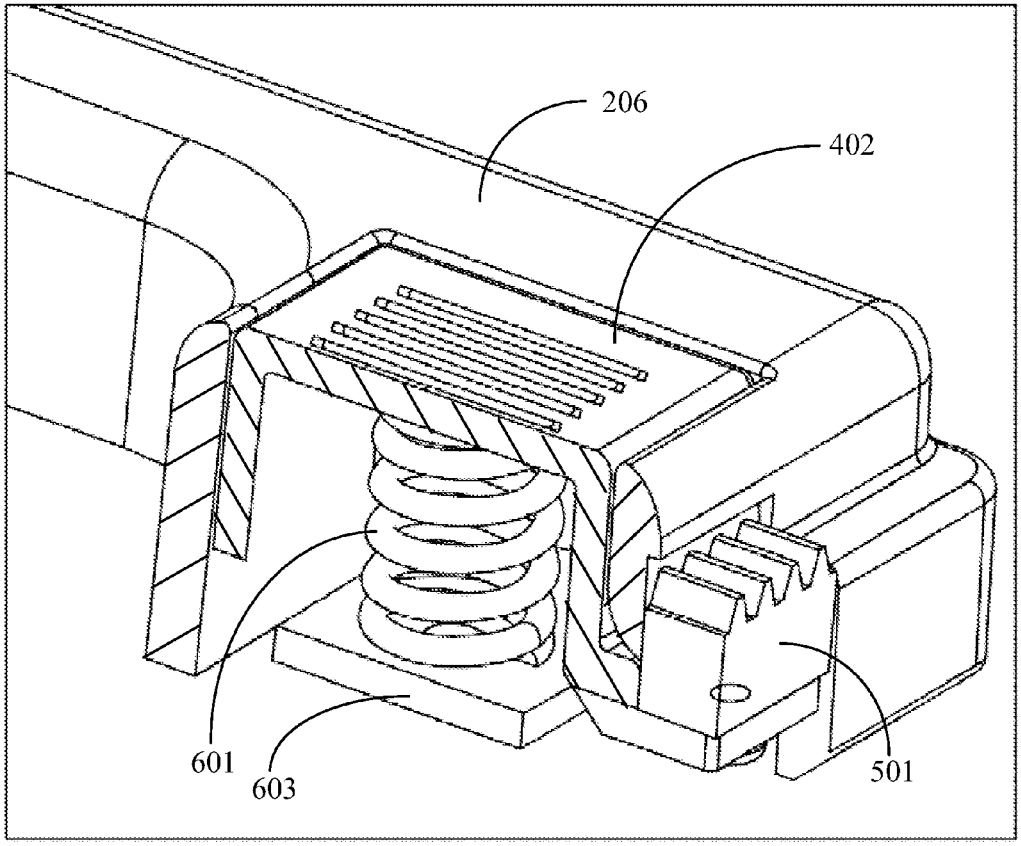
FIG. 7 is a perspective view of operable elements of the adjustable toe stop of FIG. 5.

FIG. 7 is a cutaway view of a portion of adjustable toe stop 206 showing button 402, spring 601, plate 603 and rack 501 assembled in place.

Typically a user, before using the apparatus of the invention for exercise, will use his or her ski boots to set the proper position of toe stops 206 with buttons 402. The user may then put on the ski boots, and mount the apparatus for exercise.

A skilled person will realize that the elements and arrangements as described in the examples and embodiments in this specification may be altered in various ways without departing from the scope of the invention. The scope is limited only by the claims that follow.

The invention claimed is:

1. A method, comprising:

putting on a pair of ski boots by a person seeking to exercise on a ski exercise machine;

stepping onto a pair of foot pads on the ski exercise machine one at a time, the foot pads implemented on a carriage rolling on arcuate rails;

engaging a rearward portion of the sole of each ski boot in each foot pad beneath a heel retainer plate as a part of each foot pad, such that the heel portion of the ski boot is constrained vertically;

placing the toe of each ski boot behind an adjustable toe stop on each foot pad such that the ski boot is constrained from moving forward in the foot pad, but the toe is not constrained vertically; and grasping a hand rail as part of the ski exercising machine and urging the carriage side to side on the arcuate rails, simulating skiing activity.

2. The method of claim 1 wherein the person adjusts a position of the adjustable toe stop prior to mounting the ski exercise machine to exercise.

3. The method of claim 1 wherein the person, having exercised on the ski exercise machine, lifts the toes of the ski boots above the toe stops one at a time, slides the boots forward one at a time, disengaging the sole portion from under the heel retainer plate, freeing the ski boots from the foot pads, and steps off the ski exercise machine onto a platform assembly.

4. The method of claim 3 wherein, at the time of stepping off, the rolling carriage is near one end of the arcuate rails, and therefore at a height lesser than at a center of the arcuate rails, and the skier steps off the ski exercise machine onto one of two lower levels of the platform assembly.

5. The method of claim 3 wherein, at the time of stepping off, the rolling carriage is near a center of the arcuate rails, and the skier steps off onto a center, higher level of the platform assembly.

* * * * *